US010325495B2

(12) United States Patent
Mayer et al.

(10) Patent No.: US 10,325,495 B2
(45) Date of Patent: Jun. 18, 2019

(54) METHOD FOR ASCERTAINING A PARKING POSITION AND SYSTEM FOR IMPLEMENTING THE METHOD

(71) Applicant: Robert Bosch GmbH, Stuttgart (DE)

(72) Inventors: Philipp Mayer, Stuttgart (DE); Thorben Schick, Hardegsen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/843,720

(22) Filed: Dec. 15, 2017

(65) Prior Publication Data

US 2018/0190118 A1 Jul. 5, 2018

(30) Foreign Application Priority Data

Jan. 4, 2017 (DE) ..... 10 2017 200 069

(51) Int. Cl.
*G08G 1/01* (2006.01)
*G08G 1/14* (2006.01)

(52) U.S. Cl.
CPC ..... *G08G 1/143* (2013.01); *G08G 1/0112* (2013.01); *G08G 1/0133* (2013.01); *G08G 1/0141* (2013.01); *G08G 1/142* (2013.01); *G08G 1/147* (2013.01)

(58) Field of Classification Search
CPC ..... G08G 1/143
USPC ..... 340/932.2
See application file for complete search history.

(56) References Cited

U.S. PATENT DOCUMENTS

2003/0074129 A1* 4/2003 Curbow ..... G01C 21/26 701/523
2007/0040701 A1 2/2007 Browne et al.
2011/0133957 A1 6/2011 Harbach et al.
2013/0057686 A1* 3/2013 Genc ..... B60R 1/00 348/148
2014/0097971 A1* 4/2014 Barth ..... G01S 7/52004 340/932.2
2014/0266802 A1* 9/2014 Love ..... G08G 1/144 340/932.2
2014/0292541 A1 10/2014 Korman
2014/0340242 A1* 11/2014 Belzner ..... G08G 1/14 340/932.2
2015/0371541 A1* 12/2015 Korman ..... G08G 1/147 340/932.2

(Continued)

FOREIGN PATENT DOCUMENTS

DE 102004062021 A1 7/2006
DE 102009028024 A1 2/2011
WO 2016206788 A1 12/2016

*Primary Examiner* — Eric Blount
(74) *Attorney, Agent, or Firm* — Norton Rose Fulbright US LLP; Gerard Messina

(57) ABSTRACT

A method for ascertaining a free parking position for a vehicle, in which at least one measurement value is ascertained by at least one vehicle-side sensor, the at least one ascertained measurement value is transmitted by a vehicle-side communication device of at least one vehicle to a vehicle-external server unit, the at least one ascertained measurement value is evaluated with respect to a free parking position by the vehicle-external server unit, and the evaluated at least one free parking position is provided in a retrievable manner on the vehicle-external server unit. A system for implementing the method is also described.

12 Claims, 2 Drawing Sheets

(56) References Cited

U.S. PATENT DOCUMENTS

2017/0236418 A1* 8/2017 Bostick ..... G08G 1/143
340/932.2

* cited by examiner

METHOD FOR ASCERTAINING A PARKING POSITION AND SYSTEM FOR IMPLEMENTING THE METHOD

CROSS REFERENCE

The present application claims the benefit under 35 U.S.C. § 119 of German Patent Application No. DE 102017200069.4 filed on Jan. 4, 2017, which is expressly incorporated herein by reference in its entirety.

FIELD

The present invention relates to a method for ascertaining a parking position for a vehicle and to a system for implementing the method.

BACKGROUND INFORMATION

Driver assistance functions supported by distance-based methods, e.g., using ultrasonic sensors or radar, are frequently used in vehicles. It is possible to measure parking spaces using various sensors for example and to indicate these to the driver as a parking option. Normally, in a conventional driver assistance function, the control unit of the vehicle contains a measuring system and a parking space detection system. The data of the parking space ascertained within the vehicle are also used to support the driver by an automated or semiautomated parking assist when parking into a free parking position. Furthermore, some systems transmit the parking spaces analyzed and evaluated within the vehicle to a server outside the vehicle.

German Patent Application No. DE 10 2004 062 021 A1 describes a system for detecting parking spaces by passing vehicles equipped with a parking space detection system. Following the detection within the vehicle, a registered parking space is transmitted to a central station.

German Patent Application No. DE 10 2009 028 024 A1 describes a parking guidance system for navigating a parking space-seeking vehicle to a free parking position, information about available or free parking positions being detected by vehicles situated in traffic and the registered parking space being transmitted to the parking position-seeking vehicle directly or indirectly via a central station.

A problematic aspect in this respect is the low processing power or memory capacity of a conventional control unit of a vehicle. The limited memory resources allow only for a temporary storage of distance measurement values of a few meters of the corresponding vehicle trajectory.

SUMMARY

An object of the present invention includes providing a method and a system that allow for a precise and powerful parking space detection.

This object may be achieved in accordance with example embodiments of the present invention. Advantageous developments of the present invention are described herein.

According to one aspect of the present invention, a method is provided for ascertaining a free parking position for at least one vehicle, at least one measurement value being ascertained using at least one vehicle-side sensor and the at least one ascertained measurement value being transmitted by a vehicle-side communication device of at least one vehicle to a server unit external to the vehicle. The at least one ascertained measurement value is evaluated by the vehicle-external server unit for the purpose of detecting a free parking position, and the evaluated at least one free parking position is provided on the external server unit in retrievable fashion.

This makes it possible to detect parking spaces in passing using vehicle sensors or vehicle-side sensors of at least one vehicle necessary data for the parking space detection. The ascertained measurement values are transmitted by a vehicle bus system to a communication unit and are transmitted to a vehicle-external server unit or a backend server. All relevant measurement variables are ascertained by at least one passing vehicle and are transmitted to the vehicle-external server unit. The server unit for this purpose may be any server device or an entire server system. The server unit also has its own vehicle-external communication device, which is able to receive or send data wirelessly. The vehicle-external communication device is preferably suitable for transmitting data of at least one vehicle-internal communication device or to receive data from the latter. The wireless transmission may occur for example in any mobile telephony network or by WLAN. The data or measurement values ascertained on the vehicle side are analyzed by the vehicle-external server unit and are used to determine by way of an algorithm whether a free parking space exists that may be used for a parking process. The processing of measurement values and a parking space detection or parking position ascertainment thus occur on the backend, and a vehicle-internal parking space detection system may be eliminated. Even complex calculations involving a great quantity of data or a great number of different measurement values may be processed quickly and efficiently since a stationary server unit has greater processing reserves than conventional control modules of vehicles. Thus it is possible to ascertain with great accuracy even particularly long parking spaces, the ascertainment of which requires a greater memory capacity. Since there are no direct restrictions for the number of measurement values, it is possible to collect on the vehicle-side measurement values for entire streets, housing blocks or city districts for example and to transmit these in real time or at defined intervals to the vehicle-external server unit. Thus it is possible to measure or ascertain parking positions along a street. The parking positions may be oriented in parallel or perpendicular with respect to a roadway of the street. In the event that the system is able to determine a free parking position or parking space from the measurement values ascertained on the vehicle side, all characteristic data of this free ascertained parking position are retrievably stored in the vehicle-external server unit. For this purpose, a memory area of the server unit may be provided for example, or a separate server. Possible characteristic data for a free parking position may be for example the GPS position, the length and width of the parking space, time of measurement and the like. Following vehicles are thus able to access the ascertained free parking position already in advance, without having to be positioned in immediate proximity.

A driver of a vehicle thus knows even before he turns into a street, for example, whether free parking spots or parking spaces exist along this street. This may save time in the search for a parking space.

According to one exemplary embodiment, the at least one measurement value is stored on the vehicle side in a memory and/or external to the vehicle in a memory of the server unit. Preferably, a memory area of the server unit or a separate server may be provided in order temporarily to store outside of the vehicle the measurement values detected on the vehicle side and transmitted to the server unit. Alternatively, it is possible to use also a vehicle-side intermediate memory that stores the measurement values temporarily even prior to the transmission by the communication unit to the vehicle-external server unit.

In another exemplary embodiment, the at least one vehicle-side sensor is used to ascertain a measurement value such as for example the speed and/or the distance and/or the route traveled and/or the vehicle position and/or the vehicle orientation and/or the time. Because of the processing power and memory capacity of the vehicle-external server unit, it is possible to take any parameter into consideration when ascertaining or calculating the at least one free parking position. The quantity of data that may thus be collected results in a high accuracy in detecting parking spaces and a low detection error rate.

According to another exemplary embodiment, the at least one free parking position ascertained outside of the vehicle is requested by the vehicle-side communication device of at least one vehicle based on at least one parameter. The at least one parameter may be for example a GPS position of a vehicle that falls below a defined distance from the free parking position. Thus it is possible to request on the side of the vehicle free parking positions in a defined perimeter and to display these to the driver. Furthermore, it is possible to use a destination entry in a vehicle-side navigation device for the purpose of requesting available free parking positions when or prior to reaching a destination.

According to another exemplary embodiment, the at least one free parking position ascertained outside of the vehicle is transmitted to the vehicle-side communication device of the at least one vehicle by the vehicle-external server unit. This makes it possible, for example, for at least one vehicle to transmit its position to the vehicle-external server unit at regular intervals or in real time so that the vehicle-external server unit, at least based on the position of the vehicle, transmits possible free parking positions to the vehicle-side communication device for further use.

In another exemplary embodiment, the at least one ascertained measurement value and/or the at least one free parking position detected from the latter by the server unit are compared with stored data from earlier trips of the at least one vehicle provided by the server unit. This makes it possible for example to update the retrievably provided free parking positions on the vehicle-external server unit. Preferably, the provided free parking positions may be retrievable for a limited time so that it is not possible to retrieve obsolete and thus erroneous parking positions. The duration of the retrievable provision of the free parking position on the vehicle-external server unit may depend for example on a day of the week, on local events or on a volume of traffic that is a function of the time of day.

According to another exemplary embodiment, the at least one ascertained free parking position is transmitted to a navigation system of the at least one vehicle. This allows the vehicle-side navigation system to display available free parking positions in a defined perimeter. Alternatively, it is also possible for free parking positions to be displayed in a defined perimeter of a destination entry or to be suggested as potential subsequent destinations.

In another exemplary embodiment, the at least one ascertained free parking position is used for an automatic or semiautomatic parking process. This allows a parking assist system to support the driver of a vehicle during the parking process.

In another exemplary embodiment, the at least one free parking position ascertained by a vehicle-external server unit is transmitted to a stationary parking guidance system. This makes it possible to transmit parking positions that have become free to a local vehicle-external parking guidance system for example. This may be used for example to display the number of free parking positions in a municipal parking guidance system.

According to another aspect of the present invention, a system is provided for implementing a method for ascertaining a free parking position. The system includes at least one vehicle having at least one vehicle-side sensor for ascertaining at least one measurement value and having a vehicle-side communication device for transmitting the at least one ascertained measurement value to a vehicle-external server unit. The vehicle-external server unit ascertains one or multiple free parking positions based on the at least one measurement value obtained on the vehicle side and retrievably provides the data of the ascertained free parking position.

This allows preferably a multitude of vehicles to have vehicle-side measuring sensors and to transmit the ascertained data to one or multiple vehicle-external server units. In the case of a plurality of server units, these are preferably networked with one another. The transmitted data of the measuring sensors are analyzed and evaluated in the server unit. The vehicle-external server unit in particular ascertains free parking positions based on the data of the measuring sensors so that it is possible to eliminate a vehicle-internal parking space detection system in a control unit having only a limited processing power and memory capacity. Ascertained parking positions may be provided in retrievable fashion for a plurality of vehicles. These vehicles are thus able to retrieve the ascertained free parking positions depending on the vehicle position and speed up the search for a parking space.

According to one exemplary embodiment, the vehicle-external server unit is able to transmit the ascertained free parking position to the at least one vehicle-side communication device wirelessly. This makes it possible for the vehicle-external server unit to ascertain a position of the vehicle and to transmit nearby free parking positions to the vehicle-side communication unit as a function of the position of the vehicle or of a vehicle trajectory.

In another exemplary embodiment, the ascertained free parking position is retrievable by at least one vehicle-side communication device. For this purpose, as an alternative to the previous exemplary embodiment, it is possible to transmit from the side of the vehicle a query to the server unit regarding suitable free parking positions.

According to another exemplary embodiment, the at least one ascertained free parking position is retrievable for at least one vehicle in an online memory. The ascertained free parking positions are preferably provided in retrievable fashion in such a way that they may be requested in as simple a manner as possible by a multitude of vehicles. A suitable memory could be for example a cloud.

Preferred exemplary embodiments of the present invention are explained in more detail below with reference to greatly simplified schematic representations.

BRIEF DESCRIPTION OF THE DRAWINGS

In the figures, identical constructional elements respectively have the same reference numerals.

DETAILED DESCRIPTION OF EXAMPLE EMBODIMENTS

Figure 1:
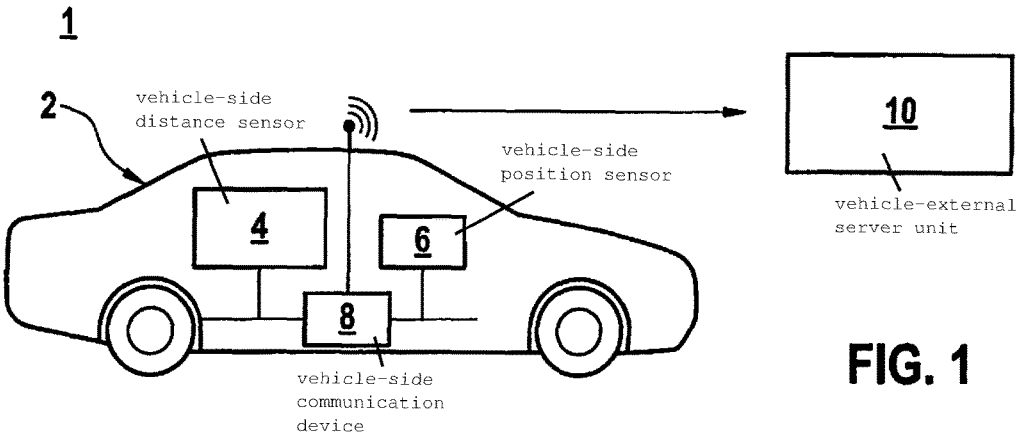
FIG. 1 shows a schematic representation of a system according to a first exemplary embodiment.

FIG. 1 shows a schematic representation of a system 1 according to a first exemplary embodiment. System 1 includes a vehicle 2 having a vehicle-side distance sensor 4, a vehicle side position sensor 6 and a vehicle-side communication device 8. Distance sensor 4 may be inter alia an ultrasonic sensor or a radar that is suitable for measuring distances in specific directions. Position sensor 6 may be for example a GPS sensor for determining a vehicle position. Communication device 8 reads out vehicle-side sensors 4, 6 and transmits the data of sensors 4, 6 wirelessly to a vehicle-external server unit 10. According to the exemplary embodiment, the wireless transmission occurs via a mobile telephony network. Server unit 10 uses the transmitted data of sensors 4, 6 to ascertain free parking positions.

Figure 2:
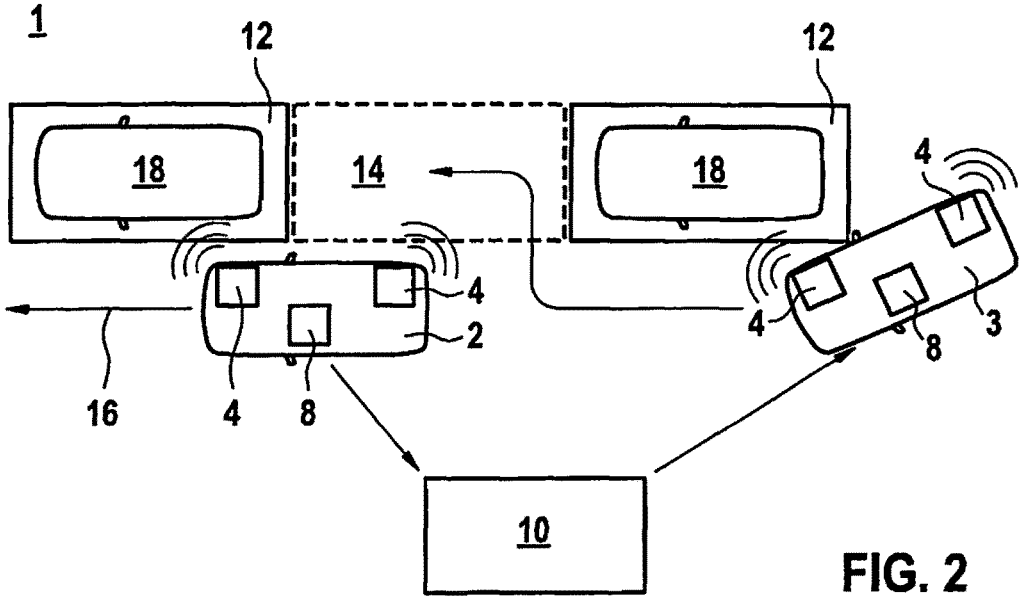
FIG. 2 shows a schematic representation of a system according to a second exemplary embodiment.

FIG. 2 shows a schematic representation of a system 1 according to a second exemplary embodiment. In this instance, a street segment is shown having a plurality of possible parking positions 12, 14 along a street 16. Two parking positions 12 are occupied respectively by a parked vehicle 18. A vehicle 2 traveling along the street segment has two distance sensors 4. While passing by, distance sensors 4 measure the possible parking position 12, 14 and with the help of communication device 8 transmit the measured data to a vehicle-external server unit 10. Server unit 10 uses an algorithm that ascertains a free parking position 14 on the basis of the transmitted data of distance sensors 4. Free parking position 14 is provided in retrievable fashion by vehicle-external server unit 10. With the aid of its communication device 8, a following vehicle 3 requests the provided data of free parking positions 14 in its proximity. At the same time, vehicle 3 also has distance sensors 4 and transmits its ascertained data of distance sensors 4 to vehicle-eternal server unit 10 with the aid of communication device 8. According to this exemplary embodiment, vehicles 3, 4 have position sensors (not shown). If following vehicle 3 is parking in free parking position 14, vehicle 3 or following vehicles (not shown) using corresponding system 1 are able to communicate to vehicle-external server unit 10 that parking position 14, which was still free a moment ago, is now no longer available. If following vehicle 3 is merely traveling along street 16, then communication device 8 transmits the data of distance sensors 4 to vehicle-external server unit 10, where they are used to update the free parking positions 14 that are provided in retrievable fashion.

Figure 3:
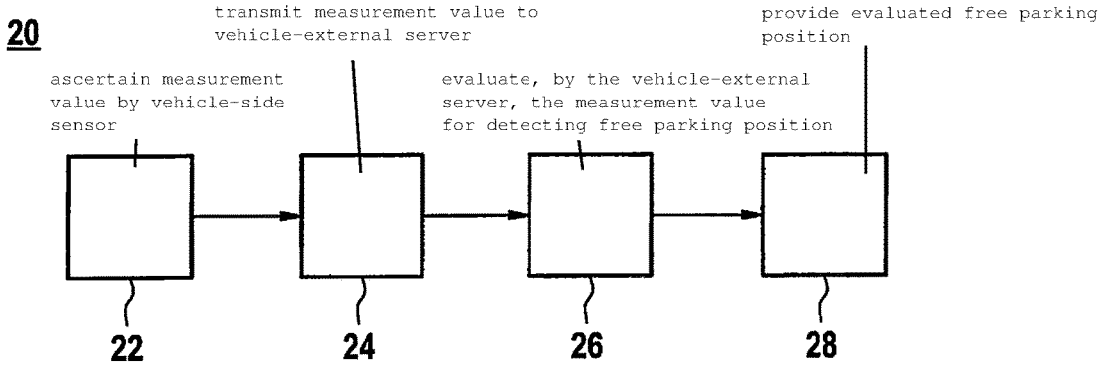
FIG. 3 shows a schematic representation of the method according to a first exemplary embodiment.

FIG. 3 shows a schematic representation of a method 20 for ascertaining a free parking position 14 for at least one vehicle 2, 3. Method 20 provides as a first step 22 an ascertainment of at least one measurement value by at least one vehicle-side sensor 4, 6. In second step 24, the at least one measurement value is transmitted by a vehicle-side communication device 8 of the at least one vehicle 2, 3 to a vehicle-external server unit 10. In third step 26, the at least one ascertained measurement value for detecting a free parking position 14 is evaluated by vehicle-external server unit 10. In fourth and final step 28, the evaluated at least one free parking position 14 is provided in retrievable fashion on vehicle-external server unit 10. This occurs only, however, if it was possible to ascertain a free parking position 14.

What is claimed is:

1. A method for ascertaining a free parking position for a vehicle, comprising:

ascertaining at least one measurement value by way of at least one vehicle-side sensor;

transmitting the at least one ascertained measurement value from a vehicle-side communication device of the vehicle to a vehicle-external server unit;

evaluating the at least one ascertained measurement value for detecting a free parking position by the vehicle-external server unit; and retrievably providing the evaluated at least one free parking position on the vehicle-external server unit, wherein at least one of: (i) the at least one ascertained measurement value, and (ii) the at least one free parking position ascertained by the vehicle-external server, is compared with stored data from earlier trips of the at least one vehicle provided by the vehicle-external server.

2. The method as recited in claim 1, wherein the at least one measurement value is stored at least one of: (i) in the vehicle in a memory, and (ii) external to the vehicle in a memory of the server unit.

3. The method as recited in claim 1, wherein the at least one vehicle-side sensor is used to ascertain at least one measurement value including at least one of: (i) a speed, (ii) a distance, (iii) a route traveled, (iv) a vehicle position, (v) a vehicle orientation, and (vi) a time.

4. The method as recited in claim 1, wherein the at least one free parking position ascertained outside the vehicle is requested by the vehicle-side communication device of at least one vehicle based on at least one parameter.

5. The method as recited in claim 1, wherein the at least one free parking position ascertained outside the vehicle is transmitted by the vehicle-external server unit to the vehicle-side communication device of the at least one vehicle.

6. The method as recited in claim 1, wherein the at least one ascertained free parking position is transmitted to a navigation system of the at least one vehicle.

7. The method as recited in claim 1, wherein the at least one ascertained free parking position is used for an automatic or semiautomatic parking process.

8. The method as recited in claim 1, wherein the at least one free parking position ascertained by a vehicle-external server unit is transmitted to a stationary parking guidance system.

9. A system for ascertaining a free parking position, comprising:

at least one vehicle having at least one vehicle-side sensor for ascertaining at least one measurement value and having a vehicle-side communication device for transmitting the at least one ascertained measurement value to a vehicle-external server unit;

wherein the vehicle-external server unit ascertains and retrievably provides at least one free parking position based on the at least one measurement value obtained on the vehicle side;

wherein at least one of: (i) the at least one ascertained measurement value, and (ii) the at least one free parking position ascertained by the vehicle-external server, is compared with stored data from earlier trips of the at least one vehicle provided by the vehicle-external server.

10. The system as recited in claim 9, wherein the vehicle-external server unit is configured to transmit the ascertained free parking position to the at least one vehicle-side communication device wirelessly.

11. The system as recited in claim 9, wherein the free parking position ascertained by the vehicle-external server unit is retrievable by at least one vehicle-side communication device.

12. The system as recited in claim 9, wherein the at least one ascertained free parking position for the at least one vehicle is retrievable from an online storage.

* * * * *